US007563172B2

(12) United States Patent
Mansfield

(10) Patent No.: US 7,563,172 B2
(45) Date of Patent: Jul. 21, 2009

(54) INTERCHANGEABLE PUTTER SYSTEM

(76) Inventor: Peter Mansfield, 720 E. Water Ct., Cannon Falls, MN (US) 55009

( * ) Notice: Subject to any disclaimer, the term of this patent is extended or adjusted under 35 U.S.C. 154(b) by 0 days.

(21) Appl. No.: 11/497,181

(22) Filed: Aug. 1, 2006

(65) Prior Publication Data

US 2007/0184915 A1 Aug. 9, 2007

Related U.S. Application Data

(60) Provisional application No. 60/771,537, filed on Feb. 8, 2006.

(51) Int. Cl.
*A63B 53/06* (2006.01)

(52) U.S. Cl. ..... 473/288; 473/340

(58) Field of Classification Search ..... 473/340–342, 473/245–246, 288

See application file for complete search history.

(56) References Cited

U.S. PATENT DOCUMENTS

| | | | | |
|---|---|---|---|---|
| 686,362 | A | 11/1901 | Streit | |
| 2,174,212 | A * | 9/1939 | Newsome | 473/251 |
| 2,381,636 | A | 8/1945 | Bancroft | |
| 2,477,438 | A | 7/1949 | Brouwer | |
| 2,777,694 | A | 1/1957 | Winter | |
| 3,791,647 | A | 2/1974 | Verderber | |
| 3,840,231 | A | 10/1974 | Moore | |
| 3,870,315 | A | 3/1975 | Lawlor et al. | |
| 3,931,969 | A | 1/1976 | Townhill | |
| 4,852,782 | A | 8/1989 | Wu et al. | |
| 4,878,672 | A | 11/1989 | Lukasiewicz | |
| 4,895,368 | A | 1/1990 | Geiger | |
| 5,152,533 | A | 10/1992 | Radakovich | |
| 5,244,210 | A | 9/1993 | Au | |
| 5,340,104 | A | 8/1994 | Griffin | |
| 5,385,346 | A | 1/1995 | Carroll et al. | |
| 5,390,919 | A | 2/1995 | Stubbs et al. | |
| 5,390,920 | A | 2/1995 | Nickum | |
| 5,393,056 | A | 2/1995 | Richardson | |
| 5,501,453 | A | 3/1996 | Hurst | |
| 5,518,543 | A | 5/1996 | Pietrowski et al. | |
| 5,538,245 | A | 7/1996 | Moore | |
| 5,749,790 | A | 5/1998 | Van Alen, II et al. | |
| 5,863,257 | A | 1/1999 | Busnardo | |
| 5,868,248 | A | 2/1999 | Joh | |
| 5,899,817 | A * | 5/1999 | Dunikoski | 473/314 |
| 5,947,840 | A | 9/1999 | Ryan | |
| 5,997,409 | A | 12/1999 | Mattson | |
| 6,001,024 | A | 12/1999 | Van Alen, II et al. | |
| 6,238,303 | B1 * | 5/2001 | Fite | 473/342 |

(Continued)

FOREIGN PATENT DOCUMENTS

| | | |
|---|---|---|
| WO | WO 2004/043549 | 11/2003 |

*Primary Examiner*—Stephen L. Blau
(74) *Attorney, Agent, or Firm*—Moss & Barnett, P.A.

(57) ABSTRACT

An interchangeable putter system for the customization of putters to individual players and for increasing the versatility of putting on various putting surfaces. The system includes a club head and a plurality of interchangeable face plates. Each of the face plates includes a front surface having a pitch or loft. The face plates are removably attachable to the club head by securing fasteners to the face plates prior to its attachment to the club head. As a result the attachment of the face plate to the club head is simplified.

18 Claims, 13 Drawing Sheets

U.S. PATENT DOCUMENTS 6,244,438 B1 6/2001 Weinmeier
6,390,930 B1 5/2002 Gauer
6,641,487 B1 * 11/2003 Hamburger ..... 473/288
6,723,000 B1 4/2004 Dombrowski
6,773,360 B2 8/2004 Willett et al.
2002/0022532 A1 2/2002 Tucker, Sr.
2004/0092332 A1 5/2004 Willett et al.
2005/0009627 A1 1/2005 Willett et al.
2005/0130757 A1 6/2005 Tucker, Sr.
2006/0172816 A1 * 8/2006 Johnson ..... 473/334

* cited by examiner

INTERCHANGEABLE PUTTER SYSTEM

CLAIM OF PRIORITY

This utility application claims the benefit of U.S. Provisional Application No. 60/771,537, filed on Feb. 8, 2006 which is incorporated herein in its entirety by reference.

BACKGROUND OF THE INVENTION

1. Field of the Invention

The present invention relates to golf clubs and more particularly pertains to an interchangeable putter system for the customization of putters and for increased putting accuracy on various putting surfaces.

2. Description of the Prior Art

The use of adjustable putters is known in the prior art. More specifically, adjustable putters heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,437,447; U.S. Pat. No. 6,863,620; U.S. Patent Application No. 2005/0130757; U.S. Pat. No. 3,791,647; U.S. Pat. No. 2,777,694; U.S. Pat. No. 4,121,832; U.S. Pat. No. 4,450,178; U.S. Pat. No. 5,385,346; U.S. Pat. No. 5,230,509; U.S. Pat. No. 5,839,974; U.S. Pat. No. 5,921,871; U.S. Pat. No. 6,238,303; and U.S. Pat. No. 4,881,739.

While these devices fulfill their respective, particular objectives and requirements, the aforementioned patents fail to provide an adjustable putter that is easily assembled and disassembled prior to the start of a round of golf or during practice, but which remains fixed to the club during play as required by the United States Golf Association.

In these respects, the interchangeable putter system according to the present invention substantially departs from the conventional concepts and a design of the prior art, and in doing so provides a system primarily developed for the purpose of customization of putters to individuals and for the increased versatility of putting on various putting conditions.

SUMMARY OF THE INVENTION

The general purpose of the present invention, which will be described subsequently in greater detail, is to provide an interchangeable putter system apparatus and method which has many of the advantages of the adjustable putters mentioned heretofore and many novel features that result in an interchangeable putter system which is not anticipated, rendered obvious, suggested, or even implied by any of the prior art adjustable putters, either alone or in any combination thereof.

To attain this, the present invention generally comprises a club head and a plurality of interchangeable face plates designed to be removably attached to the club head. In one embodiment of the invention, the club head has a top surface having indicia to aid a golfer in lining up the club head with the golf ball prior to putting. The club head also includes a bottom surface having a raised portion extending away therefrom for reducing the amount of club head surface area adjacent to a putting surface or green. The upper surface and lower surfaces are separated by a peripheral edge that extends about a rear of the club head.

The club head also includes a front surface having a generally central recess that extends into the raised portion of the bottom surface of the club head. The recess provides an air chamber between the club head and the interchangeable face plate. A centrally disposed bore extending into the front surface of the club head to receive a measurable amount of weight for a particular golfer.

The club head also includes a first notch extending into a toe portion of the club head and a second notch extending into a heel portion of the club head. Each of the notches extends generally through the front surface and through at least a portion of the peripheral edge. Each of the notches includes an inner surface having a lip formed thereon that is generally perpendicular to an axis of the notches and proximate to the front surface of the club head.

The interchangeable face plate includes a back surface and a front surface. The back surface includes a pair of spaced bores that are designed to receive a fastener that is used to removably fasten the interchangeable face plate to the club head. The front surface of the interchangeable face plate can have a loft or pitch for striking a predetermined part of a golf ball during putting. In one embodiment, a plurality of interchangeable face plates having varying lofts can be provided to a user to allow the user to change the face plate for different conditions of play and/or for different styles of putting.

The interchangeable face plate is attached to the club head by first disposing the fasteners in the bores. A user is then able to, while holding onto the interchangeable face plate, insert one of the fasteners into the first or second notch. By inserting the fastener fully into the first or second notch the user is then able to insert the other fastener into the non-occupied first or second notch. Once both fasteners are disposed in the notches the interchangeable face plate can be centered and the fasteners tightened with a provided tool. Upon tightening, a portion of the fasteners engage the lip formed in the first and second notches, thereby fixing and preventing detachment of the interchangeable face plate from the club head.

One advantage of the invention is that it allows relatively easy or simplified attachment of the interchangeable face plate with the club head while complying with the requirements of the United States Golf Association. Other devices require aligning fasteners inserted through holes in the club head into detachable striking surfaces. This is particularly difficult if done in low light environments or in inclement weather.

Another advantage of the invention is that it the simplified mode of attachment of the face plate to the club head is relatively easily done such that golfers with limited finger dexterity can change the face plates. This is considerably important in light of the fact that there are a relatively large number of senior golfers.

Yet another advantage of the invention is that it permits a putter to be easily customized to a particular golfer's putting style.

Still yet another advantage of the invention is that a golfer can change the interchangeable face plates to accommodate the difference in the conditions of the putting surface or greens on which he or she will being playing.

It is another object of the present invention to provide an interchangeable putter system which may be easily and efficiently manufactured and marketed.

It is a further object of the present invention to provide an interchangeable putter system which is of a durable and reliable construction.

Still yet another object of the present invention is to provide an interchangeable putter system which provides in the apparatuses and methods of the prior art some of the advantages thereof, while simultaneously overcoming some of the disadvantages normally associated therewith.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
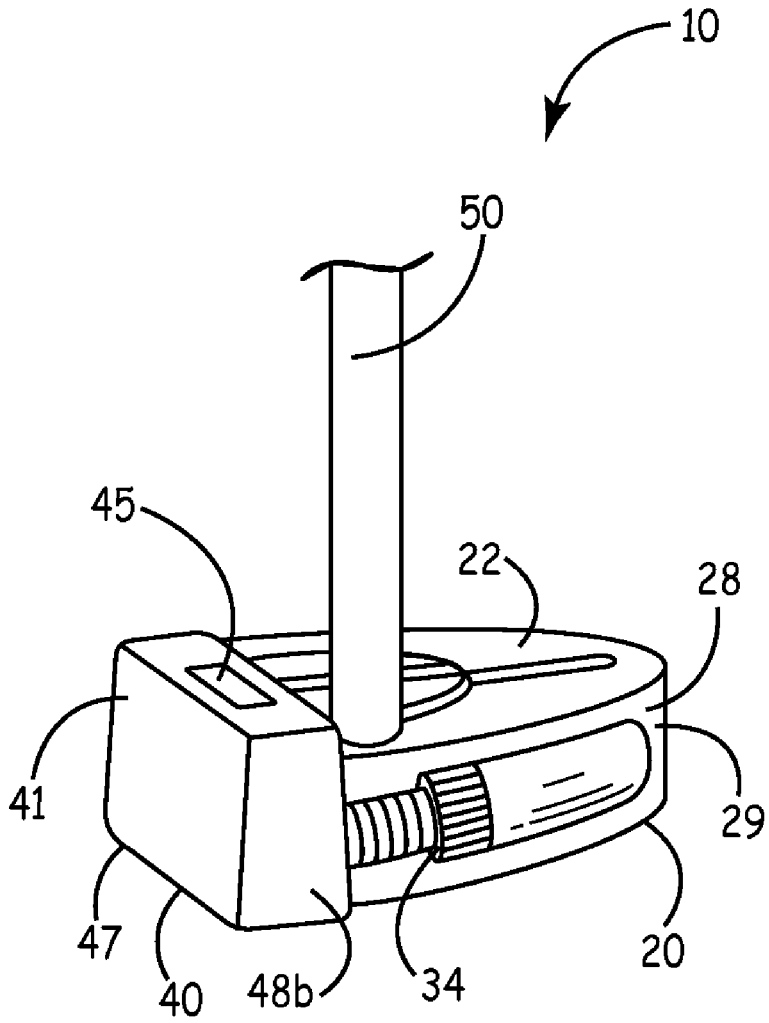
FIG. 1 is a perspective view of an interchangeable putter system according to the present invention.

With reference now to the drawings, and in particular to FIGS. 1 through 14 thereof, an interchangeable putting system embodying the principles and concepts of the present invention and generally designated by the reference numeral 10 will be described.

As best illustrated in FIGS. 1 through 13, the interchangeable putting system 10 generally comprises a club head 20 and a plurality of interchangeable face plates 40 that are designed to be removably attached to the club head 20. In one embodiment of the invention, as particularly illustrated in FIGS. 1 and 3, the club head 20 has a top surface 22 having a raised portion 23 extending up from its top surface 22. Further, the top surface 22 of the club head 20 includes indicia 24 to aid a golfer in lining up the club head 20 with a golf ball prior to putting. The indicia 24 can be lines, arrows, crosses, hatch lines, circles and the like. Any indicia can be used that will aid a user in lining up the putt. In the embodiment illustrated in FIG. 3, the indicia 24 can extend on the top surface 22 and the raised portion 24 of the club head 20.

Figure 2:
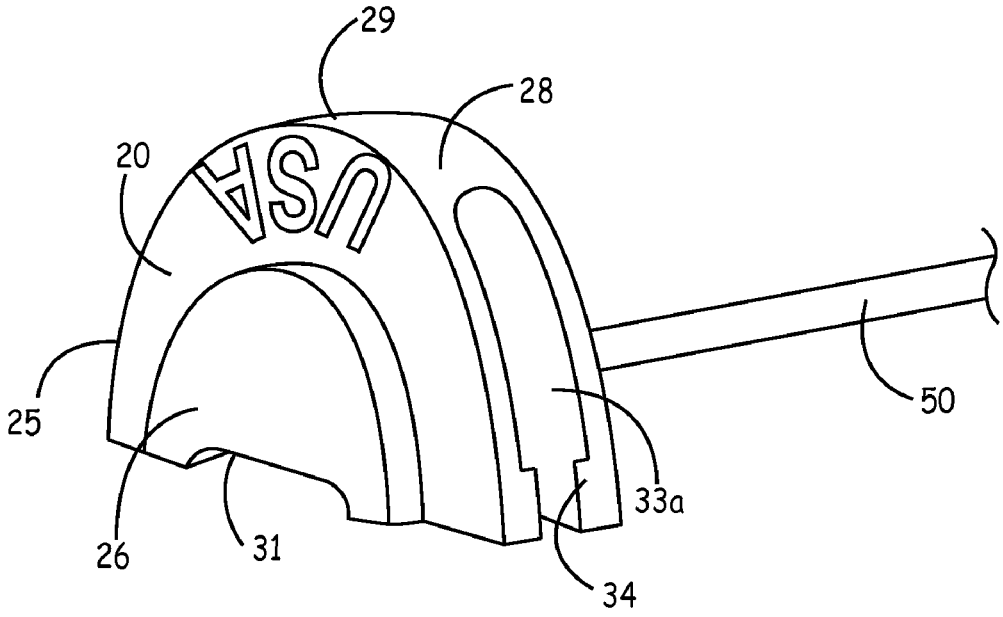
FIG. 2 is a bottom perspective view of the present invention illustrating a club head and shaft.
Figure 3:
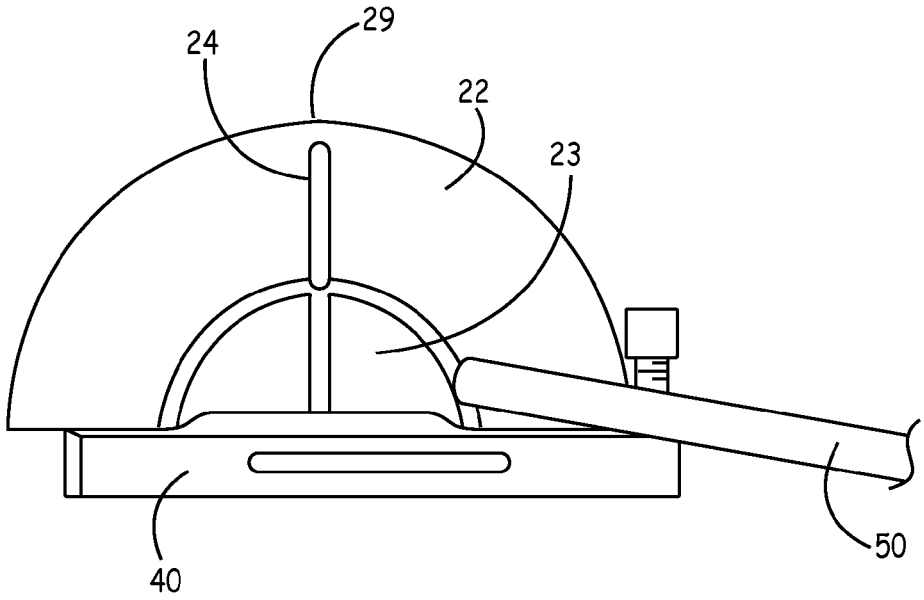
FIG. 3 is a top view of the present invention illustrating the club head face plate and shaft.

Referring now to FIG. 2, the club head 20 also includes a bottom surface 25 having a raised portion 26 extending away from its bottom surface 25. The raised portion 26 of the bottom surface 25 reduces the amount of surface area of the club head 20 that is adjacent to a putting surface or green. Reducing the amount of surface area adjacent the putting surface reduces the potential for inadvertent contact between the club head 20 and the green, which can result in a poor putt. In one example embodiment of the invention, the raised portions 23 and 26 can have a generally semi-disk shape. Other configurations are also possible and should be considered to be within the spirit and scope of the invention.

Referring to FIGS. 1-2, 4, 6, 9-11, the upper surface 22 and lower surface 25 of the club head 20 are separated by a peripheral edge 28 that extends about a rear 29 of the club head 20. The peripheral edge 28 generally forms a right angle with respect to the upper surface 22 and lower surface 25. However, other angles, slopes, pitches and the like are also possible. Additionally, the width of the club head 20 can also vary over any portion of the club head 20.

Turning to FIGS. 5-6 and 10-11, the club head 20 also includes a front surface 30 having a generally central recess or depression 31 that extends therein and into the raised portions 23 and 26 of the upper 22 and lower 25 surfaces respectfully. The recess 31 provides an air chamber between the club head 20 and the interchangeable face plate 40. A centrally disposed weight port or bore 32 extends into the front surface 31 of the club head 20 to receive a determinable weight. The weight, which can be a powder, solid, liquid or the like is used to adjust the overall weight of the interchangeable putter system for a particular golfer during fitting the of the club. The weight port or bore 32 can be threaded to receive a weight that is also threaded. The threading allows the user to fix the weight inside of the club head 20, while permitting it to be easily changed if needed. In another embodiment, the weight port or bore 32 can be sealed or blocked by a piece of material similar or dissimilar to the club head 20.

Referring now to FIGS. 1-2, 4-6, and 9-11, the club head 20 includes a first notch 33*a* extending into toe portion of the club head 20 and a second notch 33*b* extending into a heel portion of the club head 20. Each of the notches 33*a* and 33*b* extends through the front surface 30 and through at least a portion of the peripheral edge 28. Each of the notches 33*a* and 33*b* includes an inner surface having a lip 34 formed thereon that is generally perpendicular to an axis of the notches 33*a* and 33*b* and which can be proximate the front surface 30 of the club head 20. The angle of the lip 34 can vary depending upon the general axis of the notches 33*a* and 33*b*. For instance, the notches 33*a* and 33*b* can be angled toward each other or away from each other proximate the rear 29 of the club head 20. In these particular embodiments, the lip 34 can be oriented at an angle generally perpendicular to an axis of the notches 33*a* and 33*b* or they can be generally parallel the front surface 30 of the club head 20.

Figure 7:
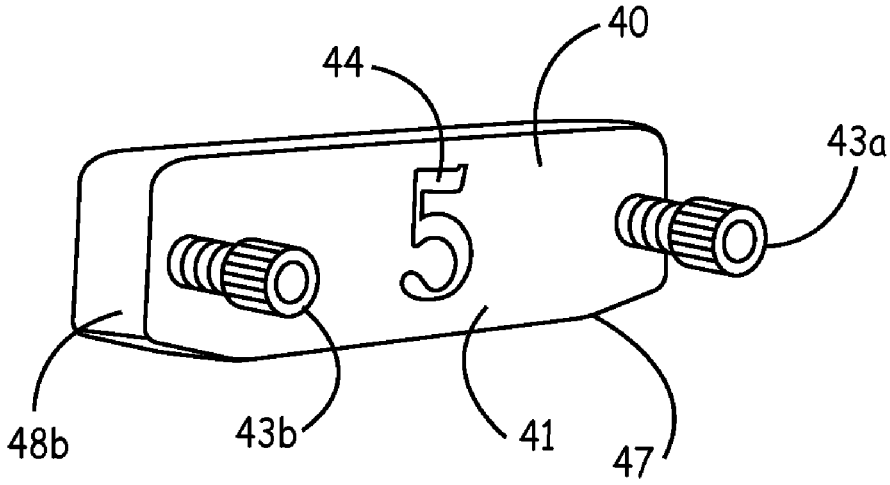
FIG. 7 is a rear perspective view of the present invention illustrating a face plate and fasteners.
Figure 8:
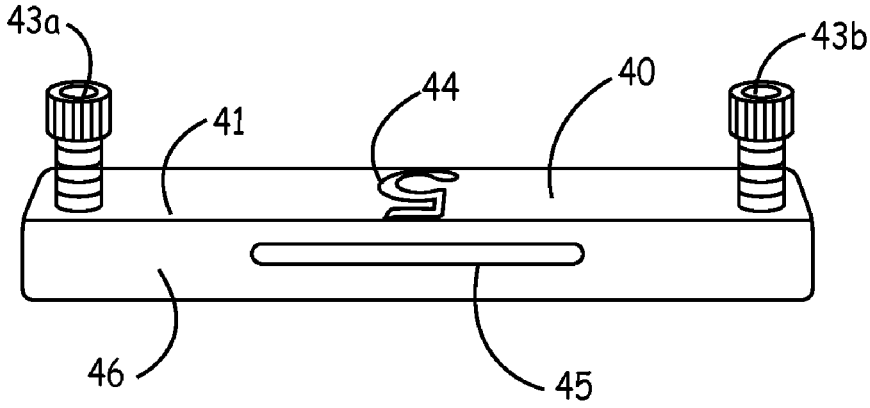
FIG. 8 is a top perspective view of the present invention illustrating a face plate and fasteners.
Figure 9:
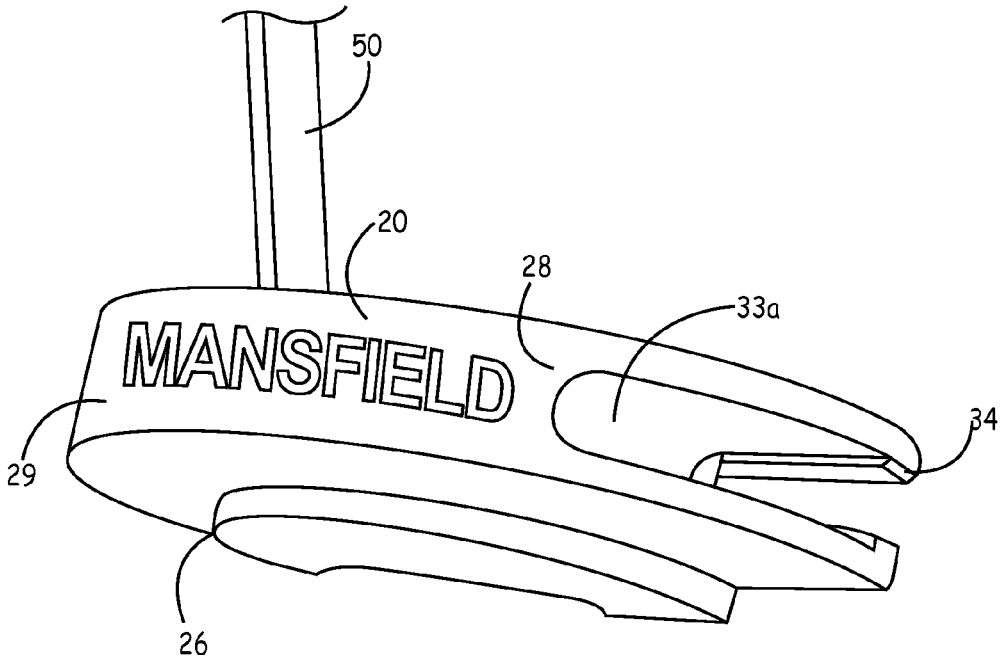
FIG. 9 is a rear perspective view of the present invention illustrating the club head without a face plate.
Figure 10:
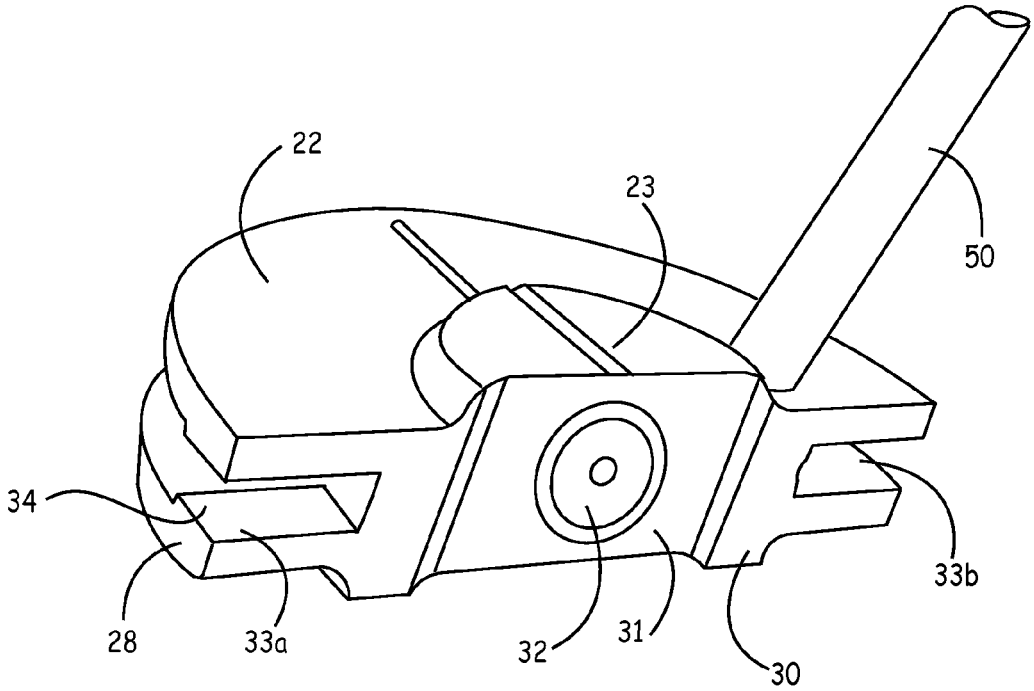
FIG. 10 is a front perspective view of the present invention illustrating the club head without a face plate.
Figure 11:
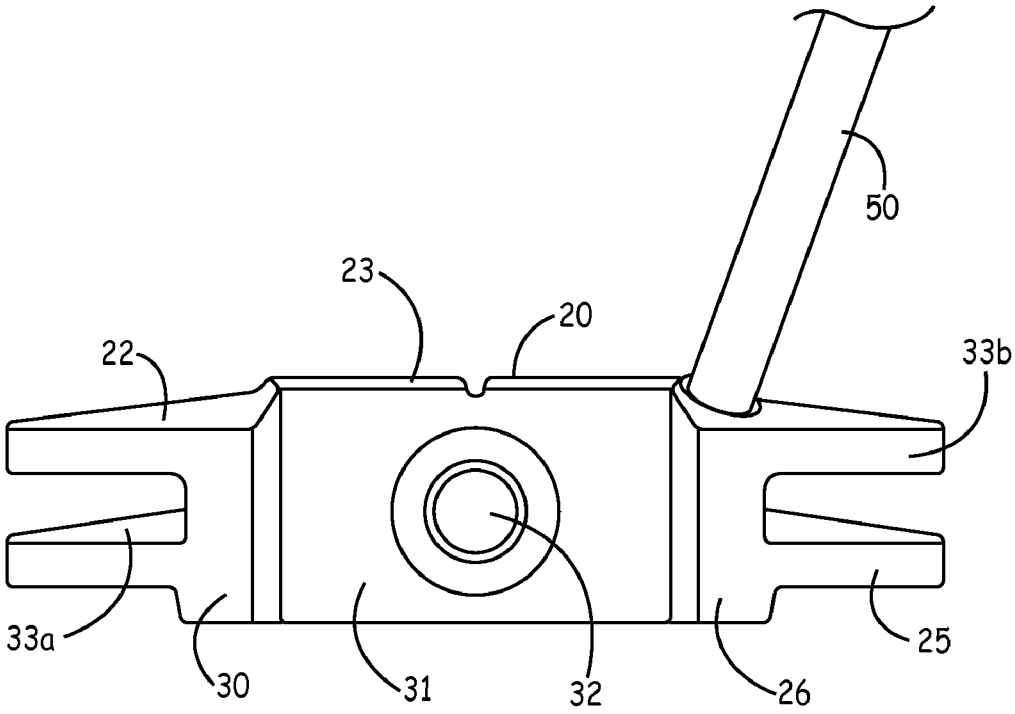
FIG. 11 is a front view of the present invention illustrating notches extending into the club head and a weight port for receiving a weighted material.
Figure 12:
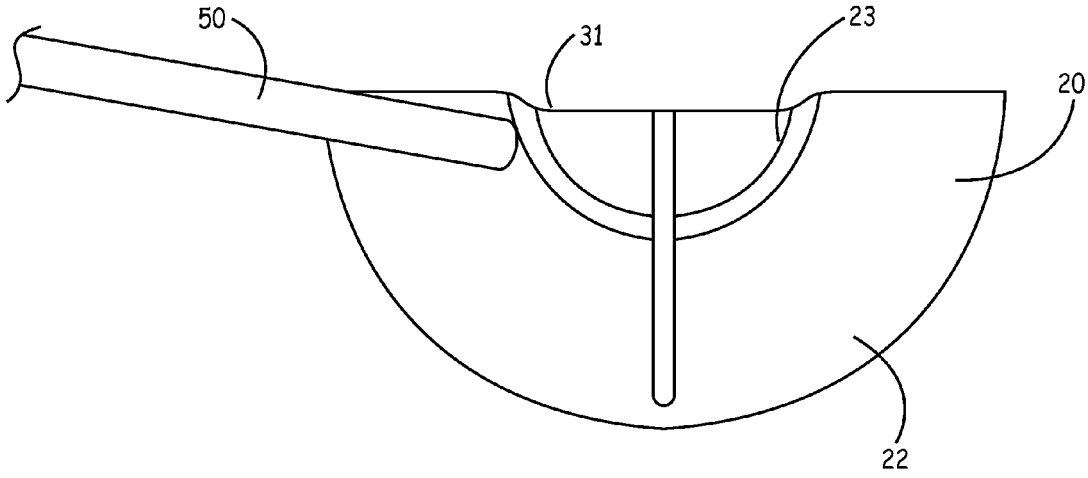
FIG. 12 is a top view of the present invention illustrating alignment indicia.
Figure 13:
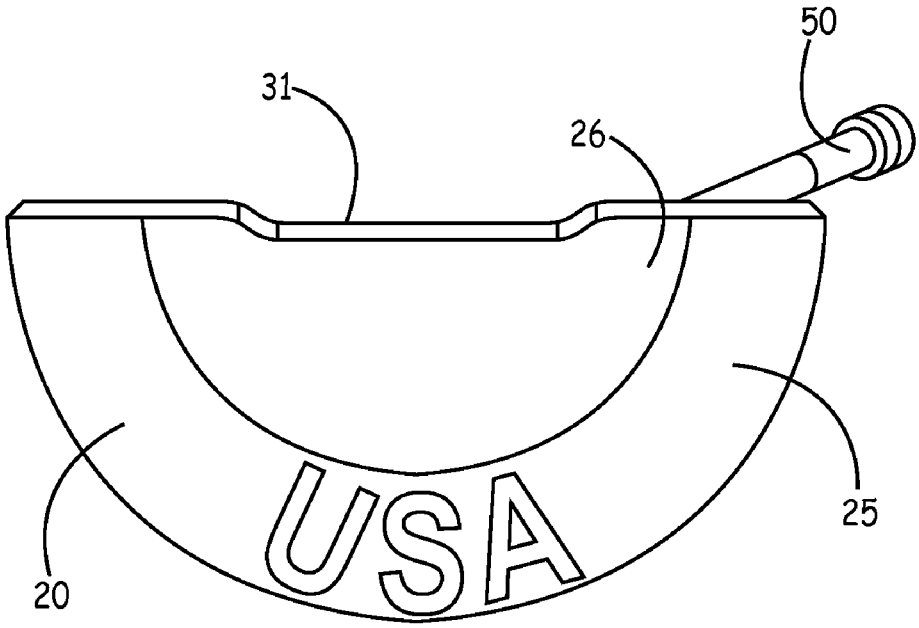
FIG. 13 is a bottom view of the present invention illustrating a recess extending into the club head.
Figure 14:
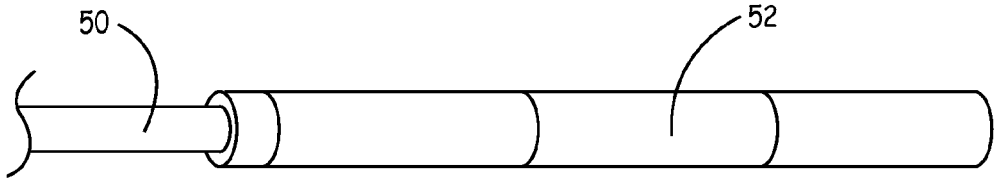
FIG. 14 is a perspective view of the present invention illustrating a grip attached to a shaft.

Referring back to FIG. 1 and to FIGS. 7-8, the interchangeable face plate 40 that is removably attachable to the club head 20 includes a back surface 41 and a front surface 42. The front surface 42 of the interchangeable face plate 40 can have a loft or pitch for striking a predetermined part of a golf ball. In one embodiment, a plurality of interchangeable face plates having varying lofts can be provided to a user to allow the user to change the face plate 40 for different conditions of play and for striking different parts of the golf ball. The pitch or loft can be positive, negative or have no loft at all.

The back surface 41 includes at least one bore for receiving a fastener designed to secure the face plate 40 to the club head 20. As illustrated in the example embodiment of FIGS. 7 and 8, a pair of spaced bores can extend into the back surface 41 of the face plate 40 with each being designed to receive a pair of fasteners 43*a* and 43*b*. The bores are preferably spaced apart such that they are in register with the notches 33*a* and 33*b* when fastened to the club head 20.

The fasteners 43*a* and 43*b* can comprise threaded screws having an allen wrench head, phillips head or the like. In this respect a tool is needed to secure or remove the interchangeable face plates 40 to the club head 20. In another embodiment, a tool is not needed and the golfer can instead use his or her fingers, coin, golf tool or the like to change the face plates 40.

In one embodiment, as illustrated in FIGS. 7 and 8, indicia 44 can be placed on the back surface 41 to permit a golfer to easily see or select the desired face plate 40. The indicia 44 can comprise numbers, letters or the like to indicate a particular loft or pitch of the face plate 40. Ball position indicia 45 may be placed on an upper edge 46 of the face plate 40. The ball position indicia 45 may comprise a single line defining an approximate region where the golf ball should be positioned before the putter.

Figure 4:
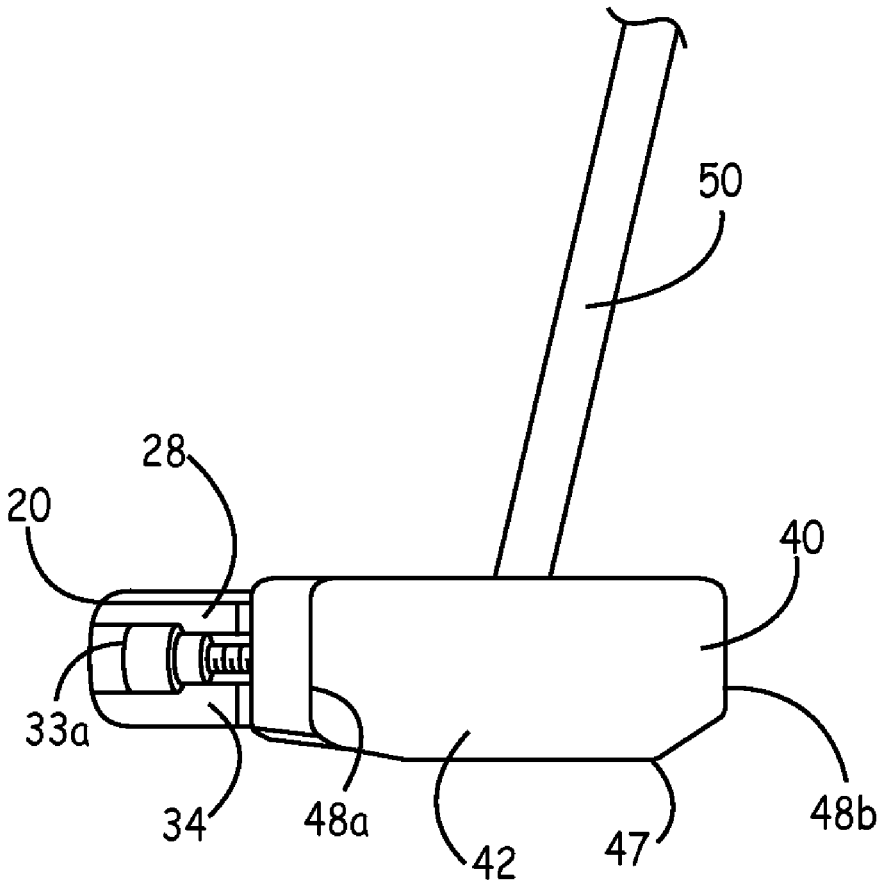
FIG. 4 is a perspective view of the present invention.
Figure 5:
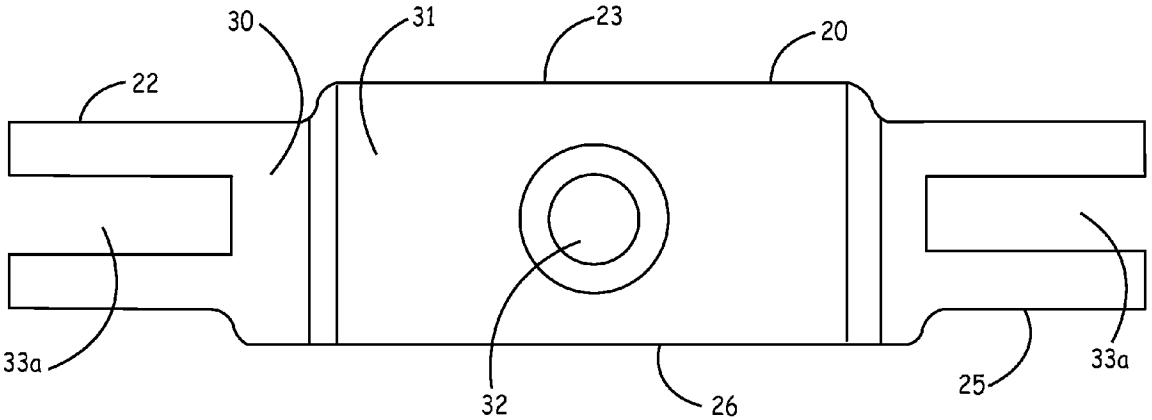
FIG. 5 is a front view of the present invention illustrating a front surface of the club head.
Figure 6:
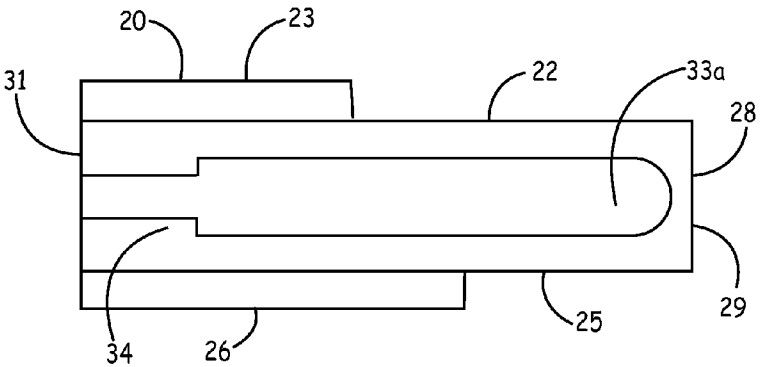
FIG. 6 is a side view of the present invention illustrating a notch extending into the club head.

Referring to FIGS. 1, 4 and 7, a lower edge 47 of the face plate 40 can have generally tapered ends 48*a* and 48*b* such that a generally central portion of the face plate 40 is wider then its ends. Although the Figures are shown having the lower edge 47 generally angled toward the ends and the upper edge 46 it should be appreciated that the upper edge 46 can also be angled toward the lower edge 47. It should also be appreciated that the face plate 40 does not need to taper or have any portion of it generally angled.

Mounted to and extending away from the club head 20 is a shaft 50 that generally creates an angle of approximately ten degrees with an axis that is tangent to a plane of the bottom of the club head 20. Other angles are also possible and should be considered to be within the spirit and scope of the invention. The shaft 50 can comprise any material such as graphite, steel, or aluminum. The shaft can also be bent or straight depending upon the preference of the golfer. Attached to the end of the shaft 50 is a grip 52 that can comprise a tape, rubber sleeve or the like. Any grip 52 may be utilized.

In another embodiment of the present invention heal to toe balance can be changed by using fasteners 43*a* and 43*b* of various weights. In yet another embodiment of the invention, removable weights, such as washers, can be added to the fasteners to add weight to the toe or heel of the club head 20.

In use, the interchangeable face plate is attached to the club head 20 by first disposing the fasteners 43*a* and 43*b* in the bores of the face plate 40. This reduces the difficulty of attaching the face plate 40 to the club head 20. A golfer is then able to insert the first fastener 43*a* into the first notch 33*a*. By inserting the first fastener 43*a* fully into the first notch 33*a*, the user is able to rotate the second fastener 43*b* passed the club head 20 and slide it into the second notch 33*b*. Once both fasteners 43*a* and 43*b* are disposed in the first notch 33*a* and the second notch 33*b* respectively the interchangeable face plate can be centered and the fasteners 43*a* and 43*b* tightened by using the provided tool or in other embodiments their fingers.

As the golfer tightens the fasteners 43*a* and 43*b* they begin to travel into the bores drawing the face plate 40 into engagement with the front surface 30 of the club head 20. A portion of the fasteners 43*a* and 43*b*, such as their heads, engage the lip 34 in the notches 33*a* and 33*b* respectively securing the face plate 40 to the club head 20.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An interchangeable golf putter comprising:

a club head having a front surface, a rear surface, a first notch and a second notch in spaced relation, each notch having a continuous opening to the outside of the head along the entire length of the notch from the front surface to the rear surface of the club head;

at least one interchangeable face plate having a front striking surface and a back surface, wherein the interchangeable face plate is positionable adjacent the front surface of the club head; and a first fastening member and a second fastening member, each member having a first and second end, the first end of each fastening member being securable to the back surface of the face plate, the second end of each first and second fastening members being positionable in the first and second notches to secure the at least one interchangeable face plate to said head.

2. The interchangeable golf putter of claim 1, wherein the club head has a top surface having indicia to aid a golfer aligning the club head.

3. The interchangeable golf putter of claim 1, wherein the club head has a bottom surface having a raised portion extending away therefrom to reduce the amount of bottom surface area adjacent to a putting surface.

4. The interchangeable golf putter of claim 1, wherein the front surface of the club head has a recess that defines a chamber between the club head and the at least one interchangeable face plate.

5. The interchangeable golf putter of claim 1, wherein the front surface of the club head includes a bore extending therein to receive a measurable amount of weighted material.

6. The interchangeable golf putter of claim 5 further comprising a seal for sealing the bore.

7. The interchangeable golf putter of claim 1, wherein the first notch extends into a toe portion of the club head and the second notch extends into a heel portion of the club head.

8. The interchangeable golf putter of claim 1, wherein the first and second notches include an inner surface having a lip, wherein the first and second fastening members engage the lip to secure the face plate to the club head.

9. The interchangeable golf putter of claim 1, wherein the back surface includes a pair of spaced bores to receive the first and second fastening members.

10. The interchangeable golf putter of claim 1, wherein a thickness of the at least one interchangeable face plate can vary imparting a loft to the front surface of the at least one interchangeable face plate.

11. The interchangeable golf putter of claim 10, wherein a plurality of interchangeable face plates are provided with each of the face plates having a different loft.

12. The interchangeable golf putter of claim 11, wherein each of the face plates includes an identifying indicia.

13. The interchangeable golf putter of claim 1, further comprising a shaft mounted to the club head.

14. The interchangeable golf putter of claim 1, wherein the first notch and the second notch open to opposing sides of the club head.

15. The interchangeable golf putter of claim 1, wherein the first notch and the second notch each have an inner lip to engage the at least one first fastener and the at least one second fastener.

16. The interchangeable golf putter of claim 1, wherein the at least one face plate has a width that varies across its height such that it has a particular loft.

17. The interchangeable golf putter of claim 16, further comprising a plurality of interchangeable face plates each having a different loft.

18. The interchangeable golf putter of claim 1, wherein the at least one first fastener and the at least one second fastener are threaded to the back surface of the at least one interchangeable face plate.

* * * * *